US010529354B1

(12) United States Patent
Betts

(10) Patent No.: US 10,529,354 B1
(45) Date of Patent: Jan. 7, 2020

(54) AUDIO AMPLITUDE UNWRAPPING

(71) Applicant: Cedar Audio Ltd, Cambridge, Cambridgeshire (GB)

(72) Inventor: David Betts, Cambridge (GB)

(73) Assignee: CEDAR AUDIO LTD. (GB)

( * ) Notice: Subject to any disclaimer, the term of this patent is extended or adjusted under 35 U.S.C. 154(b) by 0 days.

(21) Appl. No.: 16/115,676

(22) Filed: Aug. 29, 2018

(30) Foreign Application Priority Data

Jul. 10, 2018 (GB) ..... 1811287

(51) Int. Cl.
*G10L 21/0208* (2013.01)
*G10L 21/038* (2013.01)

(52) U.S. Cl.
CPC ..... *G10L 21/0208* (2013.01); *G10L 21/038* (2013.01)

(58) Field of Classification Search
CPC .... G10L 21/0208; G10L 21/038; H03M 1/18; H03M 1/06; H03G 7/00; H03G 7/002; H03G 11/00; H03G 3/3005
USPC ..... 381/102, 104, 106, 107
See application file for complete search history.

(56) References Cited

U.S. PATENT DOCUMENTS 5,754,973 A * 5/1998 Akune ..... G10H 1/16 381/106
6,795,740 B1 9/2004 Chu et al.
8,392,199 B2 * 3/2013 Otani ..... H04L 1/20 250/201.4
2013/0129115 A1 * 5/2013 Smaragdis ..... H03G 3/002 381/107

FOREIGN PATENT DOCUMENTS

CN 105845149 A 8/2016

OTHER PUBLICATIONS

GB Search Report and Examination corresponding to GB Patent Application No. GB1811287.0, dated Jan. 10, 2019.

* cited by examiner

*Primary Examiner* — Jason R Kurr
(74) *Attorney, Agent, or Firm* — Tarolli, Sundheim, Covell & Tummino LLP

(57) ABSTRACT

A computer-implemented method for restoring a wrapped audio signal comprising a plurality of digitised signal samples at respective sample times, the method comprising: estimating a sequence of corrections comprising a sequence of numerical values the estimating comprising, for each signal sample: applying, at the sample time, a numerical filter to each of a set of potential corrections to determine a filtered value associated with each set of potential integer corrections wherein the filter enhances the filtered value at sample times when a change in a degree of wrapping occurs relative to sample times when a change in degree of wrapping does not occur; determining a cumulative objective over a plurality of signal samples by accumulating objective values and determining a sequence by selecting for each sample time a correction from the set of potential corrections wherein the correction for each sample time are selected to optimise the cumulative objective.

18 Claims, 5 Drawing Sheets

AUDIO AMPLITUDE UNWRAPPING

RELATED APPLICATIONS

The present invention is a U.S. non-provisional application claiming priority to UK application no. 1811287.0 filed on 10 Jul. 2018, the entirety of which is incorporated herein by reference.

FIELD OF INVENTION

This invention relates to methods, systems and computer program code for restoring a wrapped audio signal. In example embodiments of the method, we describe an unwrapping procedure in which the audio signal is in the time domain.

BACKGROUND

Audio amplitude wrapping is a form of clipping distortion where the most significant bits have been lost but the least significant bits are still valid, analogous to numerical overflow in computational integer arithmetic. Visually this may look as if the signal wraps from one side of full scale the other.

Audio wrapping generally occurs when audio is converted to an integer incorrectly. There are two likely candidates to produce this phenomenon: one is that the firmware of some analogue to digital hard disk recorders exhibits this wrapping behaviour; the other candidate is poorly written audio processing software. Amplitude unwrapping shares some similarities with phase unwrapping, but there are two significant differences which may be exploited by the method described in the following specification. The solution presented herein is to find an unwrapping that minimises the total cost of a filtered version of the unwrapped signal.

Thus, the phenomenon of wrapping is generally an undesirable alternative to the signal being clipped at the extrema. Thus, the degree of wrapping is the number of times by which the representable range has been exceeded. The number of times can be a signed integer. That is, where the degree of wrapping is a negative numbers, the range has been exceeded from below, and a positive degree of wrapping defines wrapping over the maximum value (or 'overflowing'). The magnitude of the wrapping value defines a number of times the signal has wrapped.

SUMMARY

According to one aspect of the invention there is provided a computer-implemented method for restoring a wrapped audio signal, wherein the distorted audio signal comprises a plurality of digitised signal samples at respective sample times. The method comprises estimating a sequence of corrections comprising a sequence of numerical values to be applied to corresponding values of the plurality of signal samples of the wrapped audio signal, or estimating a sequence of corrected signal samples. The estimating comprises, for each signal sample:

applying, at the sample time, a numerical filter (alpha) to each of a set of potential corrections (n) or set of potential corrected signal samples (y) to determine a filtered value (epsilon) associated with each set of potential corrections or set of potential corrected signal samples. The corrections are integers, or similarly the potential corrected signal samples comprise signal samples modified by integer (n) multiples of a correction constant;

the filter enhances the filtered value at sample times when a change in a degree of wrapping occurs relative to sample times when a change in degree of wrapping does not occur. The method further comprises determining a cumulative objective (referred to as J) over a plurality of signal samples by accumulating objective values, each objective value being determined by applying an objective function (which may be any of a cost, penalty, or probability function etc.) to the filtered value associated with each set of potential corrections or set of potential corrected signal samples. It should be appreciated that the numerical filter may possess a filter order, which may be more than 1. That is, for a filter order greater than 1, an array of filter values is applied to a compound state comprising a group of multiple potential corrections, which can be termed a potential wrapping state.

The method may further provide determining a sequence of corrections or sequence of corrected signal samples, one for each signal sample, by selecting for each sample time a correction or corrected signal sample from the set of potential corrections or set of potential corrected signal samples for the sample time, wherein the correction or corrected signal sample for each sample time are selected to optimise the cumulative objective; and determining a restored version of the wrapped audio signal using the sequence of corrections or corrected signal samples.

In general, the correction constant is equal to the size of the representable range of the audio signal, and can generally be any real finite number e.g. a correction constant of 2 if the representable range is +/−1. The audio signal may also be normalised or scaled in many different ways, for example, the representable range may be +/−pi, in which case the correction constant will be 27 or an integer multiple of thereof. It will be appreciated that n is generally bounded in a discrete set, and is generally always an integer (or bounded discrete set of integers) irrespective of the representable range. By way of example, the set of corrections (n) may be {−1, 0, +1}.

Generally, the degree of wrapping may be defined as how many times a signal has been wrapped outside of its representable range. Furthermore, wrapping, or a wrapped digital value of a signal may be defined as when the 'true value' of the signal exceeds either extrema of the representable range (that is, goes above a maximum, or goes below a minimum) of a digital value and is thus 'aliased' back into the representable range. Thus, the phenomenon of wrapping is generally an undesirable alternative to being clipped at the extrema. Thus, the degree of wrapping is the number of times by which the representable range has been exceeded. The number of times can be a signed integer. That is, where the degree of wrapping is a negative numbers, the range has been exceeded from below, and a positive degree of wrapping defines wrapping over the maximum value (or 'overflowing'). The magnitude of the wrapping value defines a number of times the signal has wrapped. It will be understood that wrapping of audio signal may be seen as analogous to numerical overflow/underflow in the field of computational floating point arithmetic, given a computer may only represent a number up to a finite number of computer bits, e.g. 16 bits. For example, a common cause of audio wrapping occurs where a 24 bit or 32 bit representation of audio is incorrectly truncated down to 16 bits.

In some embodiments of the method, a potential wrapping state may be defined which comprises a potential correction from the set of potential corrections or a potential corrected signal sample from the set of potential corrected signal samples, and wherein there are multiple potential wrapping states for each sample time. Embodiments of this method may further comprise:

determining the cumulative objective, for each of a set of paths, each path comprising a time sequence of the potential wrapping states, one for each sample time, wherein the cumulative objective is determined for a path by accumulating the objective value from the filtered value for transitioning from each potential wrapping state in the path to the next potential wrapping state in the path, and wherein the filtered value for transitioning from each potential wrapping state in the path to the next potential wrapping state in the path is determined for the plurality of potential corrections or plurality of potential corrected signal samples defined by both the potential wrapping state and next potential wrapping state; and may also comprise identifying an optimum path which identifies the sequence of corrections or corrected signal samples used to determine the restored version of the wrapped audio signal.

It will be understood that this embodiment is an application of the Viterbi algorithm for finding an optimum path. However, the skilled person will appreciate that general Viterbi algorithm must be substantially recast in order to be applicable to embodiments of the method described in this specification, due to the nature of the problem solved by the present application (i.e. restoring a wrapped signal). It will be further understood that the embodiments of the algorithm described here relate to an algorithm using the smallest filter order (for example if the filter order is defined hereinafter as P, P=1 represents the smallest filter order). This may also be known as a "two tap" filter. In more detail, such a filter may be a finite impulse response filter (FIR filter), in which it will be generally understood that an FIR filter of order P will have P+1 terms (thus, P=1 corresponds to a 'two-tap' filter).

In yet more embodiments of the method, a potential wrapping state comprises a plurality of potential corrections from the set of potential corrections or a plurality of potential corrected signal samples from the set of potential corrected signal samples, and wherein there are multiple potential wrapping states for each sample time. Embodiments of this method may further comprise:

determining the cumulative objective, for each of a set of paths, each path comprising a time sequence of the potential wrapping states, one for each sample time, wherein the cumulative objective is determined for a path by accumulating the objective value from the filtered value for transitioning from each potential wrapping state in the path to the next potential wrapping state in the path, and wherein the filtered value for transitioning from each potential wrapping state in the path to the next potential wrapping state in the path is determined for the plurality of potential corrections or plurality of potential corrected signal samples defined by both the potential wrapping state and next potential wrapping state; and may also comprise identifying an optimum path which identifies the sequence of corrections or corrected signal samples used to determine the restored version of the wrapped audio signal.

It will nevertheless be understood that in embodiments of the above method there is one filtered value for each pair of states, referring to the filtered value for transitioning from each potential wrapping state in the path to the next potential wrapping state in the path. Furthermore, it should be appreciated that states have multiple n, or may be viewed as a compound of n's for a plurality of sample times. Thus, embodiments wherein potential wrapping states comprise a plurality of potential corrections may bear similarities to the Viterbi algorithm for finding an optimum path. It will be understood that these embodiments correspond to having a higher filter order, i.e. P=2 or more.

However, in addition to being substantially recast in order to be applicable to audio unwrapping, a further departure may be taken from the conventional Viterbi, due to the potential wrapping states comprising a plurality of potential corrections (i.e., a set of possible combinations of n). In such a scenario, it will be understood that a greater number of possible paths must be objectively considered for transitioning from each potential wrapping state in the path to the next potential wrapping state in the path. It should therefore be understood that this may represent a cumbersome computational undertaking. In other words, a great number of possible candidate paths must be objectively calculated during the algorithm, which may be very computationally expensive. Advantageously, embodiments of the present specification provide improvements for overcoming such potential computational expenses in order to make the problem tractable. By way of introduction, such advantageous methods may include a segmented algorithm in which audio samples where there is a potential change in the degree of wrapping are identified in order to reduce the number of possible paths to be objectively considered by the algorithm.

Advantageously, embodiments of the present specification provide improvements for overcoming such potential computational expenses. For example, the allowable change in degree of wrapping may be limited at each sample to reduce the number of possible paths. For example the change in degree in wrapping might be limited to $\{-1, 0, +1\}$ at each sample.

In some embodiments of the method, the objective function may be a cost function, and the cumulative objective may be a cumulative cost. Thus, the correction or corrected signal sample for each sample time are selected to minimise the cumulative cost determined from the cost function. Furthermore, in other embodiments of the method, the objective function may be a probability function and the cumulative objective may be a cumulative likelihood. Thus, the correction or corrected signal sample for each sample time are selected to maximise the cumulative likelihood determined from the probability function.

It will be appreciated by the skilled person that, in any embodiment of the method, the corrections comprised in the set of potential corrections may be chosen from a discrete set of integers between an upper and lower bound. In other words, the set of potential corrections may be a set drawn from a discrete set of integers lying between an upper and lower bound. The potential set may comprise all possible values and/or combinations of integers within this set. In one example, the set of potential corrections (i.e. n) may be the set of integers between −4 and +4. Similarly, potential corrected signal samples may comprise signal samples modified by integer (n) multiples of a correction constant, where the integer multiples are drawn from a discrete set of integers (e.g., integers from −4 to +4), which multiply a correction constant. This correction constant may be 2, where 2 is the complete span of the representable range.

The skilled person should appreciate that, in any embodiment of the method, the wrapped audio signal may possess at least one region of the signal samples at respective sample times having wrapped amplitude, and wherein the restored audio signal may possess an amplitude at each sample time determined to be a most-likely original amplitude of a source audio signal. That is, the restored version of the audio signal may be determined such that it reflects, or preferably exactly replicates, the original amplitude at each respective signal time for some source (analogue or digital) audio signal before the wrapping occurred.

The skilled person will further understand that, in any embodiment of the method, a previous estimation of the restored audio signal may be further refined. This refining may be an iterative process in which each output may subsequently be used as new input for even further refinement, an arbitrary number of times. The refining may comprise reusing the previous estimation of the restored audio signal as a further input audio signal, estimating one or more further sequence of corrections comprising a sequence of numerical values to be applied to corresponding values of the plurality of signal samples of the further input audio signal, or estimating a further sequence of corrected signal samples. The refining may additionally comprise determining a refined restored version of the wrapped audio signal using the further sequence of corrections or further corrected signal samples.

Advantageously, reusing the most recent output restored audio signal in the unwrapping algorithm as a further input is guaranteed to produce at least as good a result for the refined restored audio signal. Furthermore, iteratively performing this method confers guaranteed convergence, since successive iterations must find a path that is as least as good as the previous path.

In embodiments, one or more different numerical filters may be applied for each reuse of a restored audio signal. In other words, during each pass of the algorithm in refining a restored audio signal, a further filter may be chosen for each pass which is optimally suited for emphasising the wrapping transitions for each further input audio signal. For example, the filter may be a predetermined constant numerical filter comprising one or more constant numerical values, and may also be determined from a representative clean audio signal having undistorted audio. The numerical filter is a predetermined numerical filter comprising one or more constant numerical values.

In other embodiments, the numerical filter is a time dependent numerical filter, wherein the time dependent numerical filter is varied for at least one of the signal samples, or at least some local regions of the audio signal, for which the numerical filter is applied. For example, the time dependent numerical filter may optionally be calculated during the course of the method (referred to as "online"), or preferably the time dependent filter may be predetermined based on having the complete audio signal to begin with ("offline"). The calculation of the time dependent numerical filter is based on one more properties of one or more local regions of the wrapped audio signal, and wherein each local region comprises a plurality of signal samples which typically lie in the time-domain. This bears the advantage that local regions of audio having very different acoustic properties, for example different sounds produced in speech, may have different (i.e. more appropriate) filters applied to them. In some examples, the local regions may comprise 'frames' (i.e. multiple successive signal samples) within the audio signal which may last about 10 ms.

Further embodiments which are generally applicable to the method may include processing the wrapped audio signal before estimating the sequence of corrections or estimating the sequence of corrected signal samples. This processing may comprise applying to each of the plurality of signal samples a distortion-likelihood function to provide a plurality of distortion-likelihood values, and determining a subset of signal samples from the plurality of signal samples, wherein the determining is based on comparing the plurality of distortion likelihood-values to a threshold value.

It should be appreciated that determining the subset above is analogous to indicating the described subset for the purposes of the unwrapping algorithm. That is, the method may equally provide that a distortion-likelihood function is applied to the signal samples to provide a plurality of distortion-likelihood values, in order to indicate a subset of signal samples from the plurality of signal samples. It will be appreciated by the skilled person that performing such a processing, or detection, may allow for an advantageous efficiency saving when the main algorithm is carried out by a computer. Given that the 'full' algorithm does not need to be exhaustively performed on the complete audio signal, only a reduced number of possible/likely paths may be used to determine transitions from one potential state to the next.

In general, the indicated subset of signal samples comprises signal samples at sample times when a change in the degree of wrapping is determined to be likely relative to nearby signal samples. It will be appreciated by the skilled person that, in embodiments, the unwrapping algorithm is still applied to all signal samples, however, identifying the subset described above allows for potentially substantial efficiency savings.

Thus, advantageously, there is provided further embodiments of the method which may comprise: determining the cumulative objective, for each of a set of paths, each path comprising a time sequence of the potential wrapping states, one for each sample time, wherein the cumulative objective is determined for a path by accumulating the objective value from the filtered value for transitioning from each potential wrapping state in the path to the next potential wrapping state in the path, and wherein the filtered value for transitioning from each potential wrapping state in the path to the next potential wrapping state in the path is determined based only on the subset of signal samples.

In other words, changes in the degree of wrapping can only occur at the determined/indicated subset of samples above. In this way, only a reduced set of possible paths (i.e. transitions from each potential wrapping state in the path to the next potential wrapping state in the path) need be considered by the algorithm, which leads to a great efficiency saving. This embodiment may be referred to as a segmented version of the algorithm. The skilled person should appreciate that as the filter order increases, the computational expense increases. Therefore, use of the segmented version of the algorithm may become increasingly useful in conjunction with a high filter order.

Generally, in embodiments where the objective function is a cost function, said cost function may be any numerical function, and may be one of: a quadratic polynomial, or an absolute magnitude function, or other appropriate mathematical norm function. It will also be generally understood by the skilled person that the signal samples are in the time-domain.

In a related aspect of the invention, a non-transitory data carrier carrying processor control code is provided which, when running, implements the various embodiments of the method herein described.

In another related aspect the invention provides a processing system for restoring processing system for restoring a wrapped audio signal, wherein the distorted audio signal comprises a plurality of digitised signal samples at respective sample times, the system comprising one or more processors configured to: estimate a sequence of corrections comprising a sequence of numerical values to be applied to corresponding values of the plurality of signal samples of the wrapped audio signal, or estimate a sequence of corrected signal samples, the estimating comprising, for each signal sample:

applying, at the sample time, a numerical filter to each of a set of potential corrections or set of potential corrected signal samples to determine a filtered value associated with each set of potential corrections or set of potential corrected signal samples, wherein the corrections are integers or the potential corrected signal samples comprise signal samples modified by integer multiples of a correction constant, wherein the filter enhances the filtered value at sample times when a change in a degree of wrapping occurs relative to sample times when a change in degree of wrapping does not occur; determining a cumulative objective over a plurality of signal samples by accumulating objective values, each objective value being determined by applying an objective function to the filtered value associated with each set of potential corrections or set of potential corrected signal samples; and determine a sequence of corrections or sequence of corrected signal samples, one for each signal sample, by selecting for each sample time a correction or corrected signal sample from the set of potential corrections or set of potential corrected signal samples for the sample time, wherein the correction or corrected signal sample for each sample time are selected to optimise the cumulative objective; and determine a restored version of the wrapped audio signal using the sequence of corrections or corrected signal samples.

BRIEF DESCRIPTION OF THE PREFERRED EMBODIMENTS

DETAILED DESCRIPTION

Figure 1:
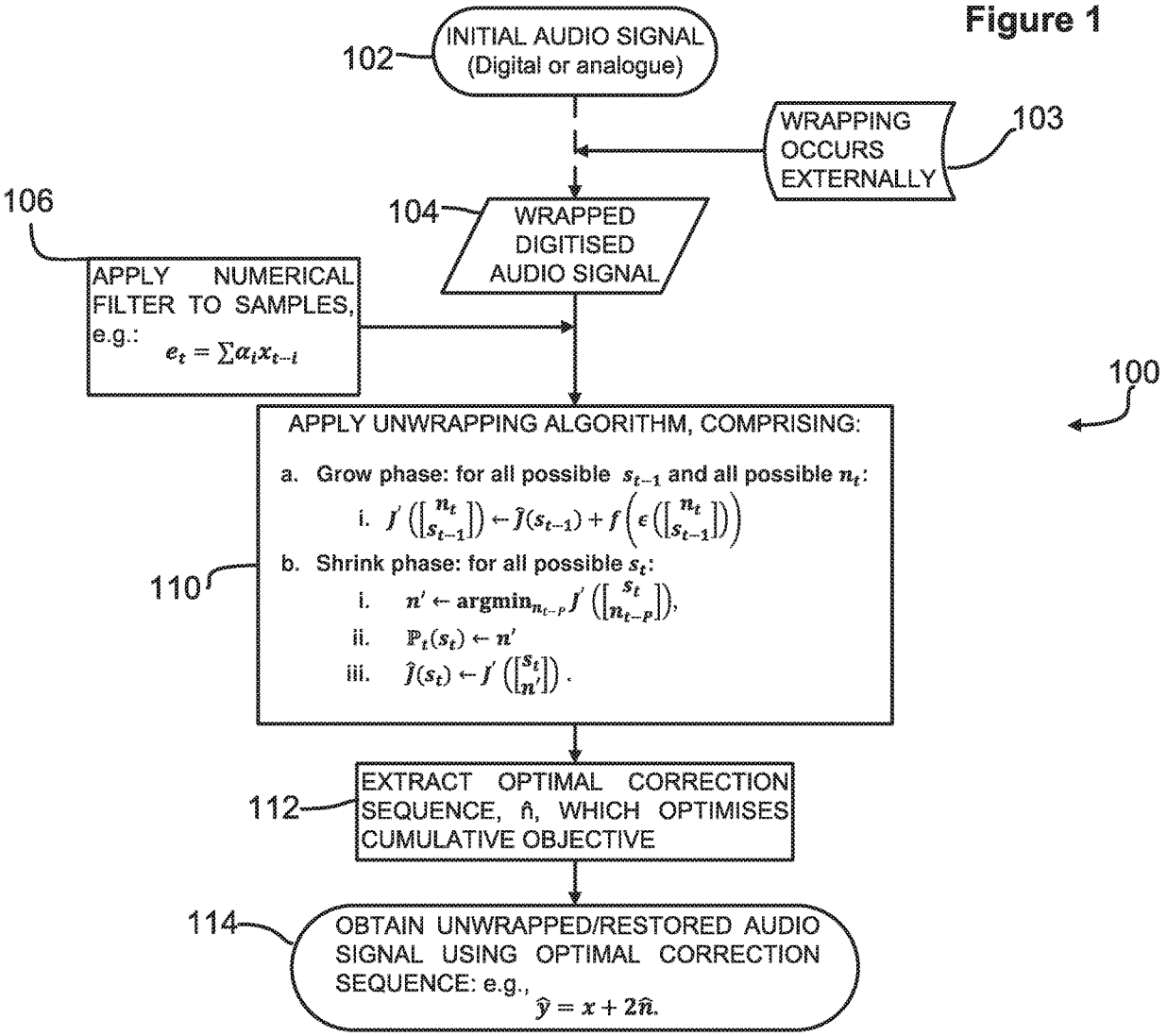
FIG. 1 shows an example procedure outlining the steps of carrying out the unwrapping algorithm.

Amplitude unwrapping shares some similarities with phase unwrapping, but there are two significant differences which may be exploited in the method described in this specification, in order to achieve better accuracy than typical phase unwrapping. Firstly, perfectly unwrapped phase can increase continuously over a sufficiently long data sequence. Real world audio amplitudes won't increase continuously and are locally zero mean. Due to these features, we describe a method which is able to use a different class of algorithms to solve the problem of restoring audio with distorted/wrapped amplitude. Secondly, mathematical models mat be used that are more appropriate for correcting audio amplitude signals, and which improve the reconstruction/restoration of the distorted audio signal.

The method of the present specification may generally assume that the signal amplitude wraps at values of ±1. In some embodiments, an algorithm in the present method may rescale or normalise the source/original audio signal in order to achieve these upper/lower bounds of unity. The algorithm is generally directed at providing a solution in which an unwrapped signal is determined which is considered an optimal unwrapped signal. For example, an optimal unwrapped signal may be one which minimises the total cost of a filtered version of the unwrapped signal.

An observed audio sample may be defined as $x_t$.

In the present method, the signed integer $n_t$ may be defined as a latent variable (otherwise known as a hidden variable) that represents the number of times the signal has been wrapped. In general terms, the integer $n_t$ may represent the "link", otherwise known as the "hidden cause" between the digitally observed distorted (for example, wrapped) audio signal, and the audio signal which was the original source of audio (which was subsequently recorded as digitised).

The unwrapped signal may be defined as:

$$y_t=x_t+2n_t,$$

where y is the unwrapped signal that the algorithm wishes to predict, x is the audio signal which is observed, which may have one or multiple points/where amplitude wrapping has occurred. For example, x may represent the audio signal after it has been digitally stored, and during the process of digitisation has become undesirably wrapped/distorted. Therefore, the set, or "path" of integer values $n_t$ is what the restoration algorithm predictively aims to obtain. The above equation may also be defined in vector notation:—

$$y=x+2n$$

$$y,x\in\mathbb{R}^{T+1}$$

$$n\in\mathbb{Z}^{T+1}$$

It is possible to define $\epsilon_t$ as the filtered version of this unwrapped signal. In embodiments of the method, the filter is generally a numerical filter which may have a finite impulse response defined by the coefficients $\alpha_i$:

$$\epsilon_t=\Sigma\alpha_i y_{t-1}$$

It may also be convenient for the method to define an intermediate value $e_t$ $$e_t=\Sigma\alpha_i x_{t-i}$$

$$\epsilon_t=e_t+2\Sigma\alpha_i n_{t-i}$$

Alternatively expressed, in vector notation as $$\epsilon_t=\alpha^T x+2\alpha^T n$$

Where the superscript T denotes a transpose of the vector, and where $i\in[0,P]$ such that $\alpha, x, \epsilon\in\mathbb{R}^{P+1}$, $n\in\mathbb{Z}^{P+1}$. It will be readily understood by the skilled reader that α, x, n are all vector quantities in the present example, and ϵ is a scalar quantity In one embodiment of the method, the filter $\alpha_i$ and its respective coefficients may be fixed and optionally known a-priori (that is, predetermined before the algorithm is applied to the audio signal). In another embodiment, the filter can be time varying in which case they may be denoted by further time subscript $\alpha_{ti}$. In greater detail, the filter may depend on which region of the audio signal it is being applied to, and may in some examples be dependent upon other features of the audio signal such as local frequency or amplitude.

In yet another embodiment, the filter may be one which is designed to emphasise changes in the degree of wrapping while reducing the signal energy. In the case of audio, this filter may be some form of high pass filter. The filter may be a finite impulse response filter (FIR filter), in which it will be generally understood that an FIR filter of order P will have P+1 terms (thus, P=1 corresponds to a 'two tap' filter).

The objective function (or penalty, or probability, or cost function), may be denoted as $f(\epsilon_t)$. For example, the functional form of a cost function may be the squared value $\epsilon_t^2$, or the absolute value $|\epsilon_t|$, though it will be understood that any suitable cost function may be used. For the sake of the derivation and description the squared value is generally referred to in this specification.

J may then be defined as the total cost, or cumulative cost, over the observable samples given the filter coefficients and the wrapping values:

$$J(n_T, \ldots, n_0) = \sum_{t=0}^{T} f(\epsilon_t).$$

The objective of the algorithm in the present specification is therefore to find the optimal path n. For example, the optimal path may generally be the path which minimises this cost function J as defined above. It may also be a path which maximises a cumulative likelihood derived from a probability function.

In one example of the method, and offline version may be implemented where the method operates on pre-recorded audio with access to a variety of audio samples. Without loss of generality it may be assumed that the filter coefficients are indexed as $i \in [0,P]$. This may be achieves by delaying or advancing the definition of $\epsilon_t$ as appropriate.

The present method may subsequently wrap the P most recent values of $n_t$ into a state variable $s_t \in \mathbb{R}_P$ which may be defined as:

$$s_t = \begin{bmatrix} n_t \\ \vdots \\ n_{t-P+1} \end{bmatrix}.$$

Optionally, the values of $n_t$ may be bounded by $K_L \leq n_t < K_U$. For example, the method may generally use values of $K_L = -8$ and $K_U = 8$, though any suitable values may be used. It follows that each $n_t$ can take $K_U - K_L$ possible values, and $s_t$ can take $(K_U - K_L)^P$ possible values. Thus, in the present example, $n_t$ may be represented and stored in the memory of a computer as a 4 bit nibble (where a nibble will be understood in the field of computing to be equal to 4 computational bits) and $s_t$ may be stored in the memory of a computer as a 4P bit word. The delay operator to move from $s_{t-1}$ to $s_t$ may then be implemented in the algorithm in terms of bit shifts and bitwise logical operations, and it may subsequently be possible to pass through all possible values of $s_t$ by using a loop counter within the computational algorithm. It will be generally understood that a bit shift, in the field of computing, may refer to a bitwise operation in which the series of bits representing an integer number are shifted left or right in order to increase or decrease (respectively) the value of a number represented by the bits by an order of magnitude equivalent to the base used to represent the integer number.

It is possible to define an expanded version of the state, which may be denoted $s'_t$, which may grow or shrink during the course of the method. The grown/shrunk values of expanded state may be represented using the following identities $$s'_t = \begin{bmatrix} s_t \\ n_{t-P} \end{bmatrix} = \begin{bmatrix} n_t \\ s_{t-1} \end{bmatrix}$$

It is then possible to define an iterative update algorithm within the present method which may update the cumulative cost of any state sequence:

$$\epsilon_t(s'_t) = e_t + 2\alpha_t^T s'_t$$

$$J(s_t, \ldots, s_0) = f\left(\epsilon_t\left(\begin{bmatrix} n_t \\ s_{t-1} \end{bmatrix}\right)\right) + J(s_{t-1}, \ldots, s_0)$$

The cumulative cost $\hat{J}(s_t)$ may be used to represent the minimum cost over all paths that end in the state $S_t$ in the above example. This cost $\hat{J}(s_t)$ can also be calculated iteratively as follows $$J'\left(\begin{bmatrix} n_t \\ s_{t-1} \end{bmatrix}\right) = f\left(\epsilon_t\left(\begin{bmatrix} n_t \\ s_{t-1} \end{bmatrix}\right)\right) + \hat{J}(s_{t-1})$$

$$\hat{J}(s_t) = \min_{n_{t-P}} J'\left(\begin{bmatrix} s_t \\ n_{t-P} \end{bmatrix}\right)$$

Given the above iterative updates, the method of the described in the specification may the determine the optimum path (in other words, the optimum set of latent variables $n_t$). In one embodiment of the method, a two pass process may be used which may be a specific implementation of the Viterbi algorithm. In an embodiment of the method using a two-pass process, the forward pass may be used to track the optimal costs (determined by the penalty/cost function) and build/save a back link buffer $\mathbb{P}$ that remembers where the optimal costs came from. In other words, the back link buffer keeps a record of the values of $n_t$, corresponding to each signal sample, which provide the optimum (lowest) cost of the cumulative cost function. The backwards pass may then recover the optimal path, which for the present specification is denoted $\hat{n}$, from the values in the back link buffer.

In a preferable example, the method of the present specification comprises the following algorithm:

1. For all possible states $s_{-1}$ initialise $\hat{J}(s_{-1})=0$.
2. For each time (i.e., for each signal sample) t=0 to T:
   a. Calculate $e_t$,
   b. Grow phase: for all possible $s_{t-1}$ and all possible $n_t$:
      i.

$$J'\left(\begin{bmatrix} n_t \\ s_{t-1} \end{bmatrix}\right) \leftarrow \hat{J}(s_{t-1}) + f\left(\epsilon\left(\begin{bmatrix} n_t \\ s_{t-1} \end{bmatrix}\right)\right).$$

c. Shrink phase: for all possible $s_t$:

i.

$$n' \leftarrow \operatorname{argmin}_{n_{t-P}} J'\left(\begin{bmatrix} s_t \\ n_{t-P} \end{bmatrix}\right),$$

ii. $\mathbb{P}_t(s_t) \leftarrow n'$, iii.

$$\hat{J}(s_t) \leftarrow J'\left(\begin{bmatrix} s_t \\ n' \end{bmatrix}\right).$$

3. Find $\hat{s}_T \leftarrow \operatorname{argmin}_{s_T} \hat{J}(s_T)$.
4. To extract the optimal estimate ft, back track from t=T down to 0 doing:

a. $n' \leftarrow \mathbb{P}_t(\hat{s}_t)$, b.

$$s' \leftarrow \begin{bmatrix} \hat{s}_t \\ n' \end{bmatrix},$$

c.

$$\begin{bmatrix} \hat{n}_t \\ \hat{s}_{t-1} \end{bmatrix} \leftarrow s'.$$

Having recovered the optimal path $\hat{n}$, the optimal estimate of the unwrapped (restored) signal may be denoted $$\hat{y}=x+2\hat{n}.$$

It will be understood that the solution/algorithm may be implemented using an internal numeric format that can represent the unwrapped audio. The result $\hat{y}$ may need rescaling and/or re-dithering to fit into the desired output numeric format.

As previously mentioned, the filter design in a preferable embodiment is one that locally emphasises the wrapping transitions. It is therefore desirable to use an optimally matched filter for the filter $\alpha$.

Let $R \in \mathbb{R}^{(P+1)} \times^{(P+1)}$ be the expected covariance of clean audio, where $y_t$ represents typical clean audio in this case:

$$R_{ij} = E\{y_t y_{t+i-j}\}$$
$$\approx \frac{1}{T}\sum_t y_t y_{t+i-j}.$$

This may be measured as an aggregate over a wide variety of clean (i.e., undistorted) audio examples. It may generally correspond to an approximately pink spectrum, where it will generally be understood by the skilled reader that a pink spectrum refers to a signal with a frequency spectrum such that the power spectral density (energy or power per frequency interval) is inversely proportional to the frequency of the signal.

Let $v \in \mathbb{R}^{P+1}$ be a vector that represents a change in the degree of wrapping (either a step up or a step down), for example:

$$v = \pm \begin{bmatrix} 0 \\ \vdots \\ 0 \\ 2 \\ \vdots \\ 2 \end{bmatrix}.$$

It is preferable in the present method to obtain a filter design that maximises the gain ratio, G, between the gain for the transition and the gain for the clean audio, for example:

$$G = \frac{|\alpha^T v|^2}{\alpha^T R \alpha}.$$

This has the solution to provide an optimal filter $$\alpha \propto R^{-1} v.$$

There are many ways to normalise the coefficients. In one example, a convenient method is for the gain with respect to v to be unity, in which case:

$$\alpha = \frac{1}{v^T R^{-1} v} R^{-1} v.$$

There may be a trade-off between the filter order P and the amount of gain. Advantageously for the implementation in the present specification, pink-like signals get most of their benefit at a fairly low order P, so typically P≤4 may be sufficient to get a good result. Further advantageously, an acceptable result may even be obtained with P=1.

In greater detail, when the filter is applied to the set of potential corrections or set of potential corrected signal samples, in a preferable embodiment it is observed that the algorithm obtains optimal accuracy when the 'DC response' of the filter is be non-zero. This means that, should a hypothetical input to the filter be constant, then the hypothetical output of the filter would be a small constant value, and the ratio of the hypothetical output constant to the hypothetical input constant is the DC response described above. If the DC response were zero then you could add 1 to all values of $n_t$ and get exactly the same cumulative cost. Advantageously, providing a non-zero DC response avoids this, and helps the algorithm choose the path that makes the actual restored output locally zero mean.

The basic algorithm as discussed above may get computationally very costly as order P increases. A significant memory cost is remembering all the back links in $\mathbb{P}$ $$|\mathbb{P}| = 0(T(K_U-K_L)^P \log_2(K_U-K_L))$$

Correspondingly, a significant computational cost is the forward pass which possess computation order $$0(TP(K_U-K_L)^{P+1})$$

Therefore, the algorithm may become impractical when using large filter orders. It is therefore preferable to change the algorithm to allow for some efficiency savings.

Advantageously, we describe herein a processing step, to provide an efficiency optimisation, which comprises not checking for wrapping at every single sample. The method already calculates the (filtered) signal $e_t$, which may be the matched filter for detecting wrapping transitions. Therefore, the algorithm need only check for wrapping transitions where $|e_t|^2$ is greater than some threshold $\gamma$. In an example, the normalised version of the matched filters allows the method to fix this threshold somewhere between 0 and 1. It is further preferable to use a low threshold≈0.1 when performing this pre-processing step, as the method will be less likely to miss a transition.

Therefore, in one embodiment of the method, it is possible to optimise the specific implementation of the Viterbi algorithm used in this specification. This embodiment of the unwrapping algorithm may check the minimum number of possible paths, given that a reduced number of paths are checked, corresponding to samples where a change in the degree of wrapping is deemed most likely to have occurred at the detected positions.

Let $d_t$ indicate whether a potential change in the degree of wrapping has been detected.

$$d_t = \mathbb{R}\,(|e_t|^2 > \gamma)$$

We also define $\phi_t$ as a condensed version of the state $s_t$ that only stores the changes. The mapping $\phi_t \leftrightarrow s_t$ implementation details are provided in an example below:

Definition of the Mapping $\phi_t(s_t)$ Given d

1. $s_{t0} \leftarrow \phi_{t0}$
2. $k \leftarrow 1$
3. For i=1 to P−1
   a. If $d_{t-1} \neq 0$
      i. $\phi_{tk} \leftarrow s_{ti}$
      ii. $k \leftarrow k+1$ Defining the inverse mapping $s_t(\phi_t)$ given d 1. $s_{t0} \leftarrow \phi_{t0}$
2. $k \leftarrow 1$
3. For i=1 to P−1
   a. If $d_{t-i} \neq 0$
      i. $s_{ti} \leftarrow \phi_{tk}$
      ii. $k \leftarrow k+1$
   b. Otherwise
      i. $s_{ti} \leftarrow s_{ti-1}$ In embodiments of the method, is also possible to define an equivalent mapping $s'(\phi'_t)$ for the extended state $s'_t$ by indexing step 3 to P instead of P−1.

The condensed states can grow and shrink $\phi_t$ iteratively as follows $$\phi'_t \leftarrow \begin{cases} \phi_{t-1} & : d_t = 0 \\ \begin{bmatrix} n_t \\ \phi_{t-1} \end{bmatrix} & : d_t \neq 0 \end{cases}$$

$$\phi'_t \rightarrow \begin{cases} \phi_t & : d_{t-P} = 0 \\ \begin{bmatrix} \phi_t \\ n_{t-p} \end{bmatrix} & : d_{t-P} \neq 0 \end{cases}$$

Given these operations it is possible to reformulate the algorithm in section 3 to iterate only over the set of possible paths. In other words, following a pre-processing step to determine a subset of signal samples where a change in the degree of wrapping is deemed to be most likely, the algorithm may be adapted to only be performed over this subset of signal samples. Since this subset of signal-samples where wrapping is most likely provides a reduced set of possible paths (i.e. possible values of $n_t$), this embodiment (segmented version) of the algorithm provides an advantageous efficiency saving. An example of the implementation of the segmented embodiment of the algorithm is outlined as follows The segmented version of the algorithm 1. For all possible states $\phi_{-1}=[n_{-1}]$ initialise $\hat{J}(\phi_{-1})=0$.
2. For each time t=0 to T:
   a. Calculate $e_t$.
   b. Grow phase:
      i. If $d_t=0$ then for each possible state $\phi_{t-1}$:
         1. $\phi'_t \leftarrow \phi_{t-1}$,
         2. $J'(\phi'_t) \leftarrow \hat{J}(\phi_{t-1}) + f(\epsilon(s'(\phi'_t)))$.
      ii. Otherwise, for each possible $n_t$ and each possible state $\phi_{t-1}$.
         1.

$$\phi'_t \leftarrow \begin{bmatrix} n_t \\ \phi_{t-1} \end{bmatrix},$$

2. $J'(\phi'_t) \leftarrow \hat{J}(\phi_{t-1}) + f(\epsilon(s'(\phi'_t)))$.
   c. Shrink phase:
      i. If $d_{t-p}=0$ then for each possible state $\phi_t$:
         1. $\phi'_t \leftarrow \phi_t$,
         2. $J'(\phi_t) \leftarrow \hat{J}'(\phi'_t)$.
      ii. Otherwise, for each possible state $\phi_t$:
         1.

$$n' \leftarrow \operatorname{argmin}_{n_{t-p}} J'\left(\begin{bmatrix} \phi_t \\ n_{t-p} \end{bmatrix}\right),$$

2. Append the back link $\mathbb{P} \leftarrow [\mathbb{P}, n']$,
         3.

$$\hat{J}(\phi_t) \leftarrow J'\left(\begin{bmatrix} \phi_t \\ n' \end{bmatrix}\right).$$

The final steps may be similarly altered to recover the optimal path $\hat{n}$. It will be understood that the number of possible states in 2.b and 2.c varies dynamically.

Let $L_t$ be the number of elements in the state $\phi_t$ and $L'_t$ be the number of elements in $\phi'_t$. Also let T be the set of times where potential wrapping was detected by the pre-processing step. The size of the back link buffer is now $$|\mathbb{P}| = O\left(\log_2(K_U - K_L) \sum_{t \in T} (K_U - K_L)^{L_t}\right)$$

The computational cost is given by $$O\left(P \sum_{t=0}^{T} (K_U - K_L)^{L'_t}\right)$$

In examples where the detection vector d is reasonably sparse, this represents a massive saving in memory and computational cost. However, there may exist a practical limit for the maximum value of $L_t$ which means that there may exist practical limit on P of about 30. Nevertheless, it will be understood by the skilled person that any practical limitation does not limit the scope of the embodiment, and for example, the value of P may be much larger or smaller than 30 in embodiments.

In one embodiment of the present method, it is possible to pre-process d the detection vector to limit the maximum value of $L'_t$, and thereby control processing load. For values of t where $L'_t$ is too high, the method may removes the least likely detections in the vicinity $d_{t-1}$ to $d_{t-p}$. We keep doing this removal process until $L_t$ has an acceptable upper limit maxL.

1. L←1
2. For t=1 to T:
   a. If $d_{t-1}\neq 0$
      i. If L≠maxL
         1. L←L+1
      ii. Otherwise
         1. $\hat{t}\leftarrow \text{argmin}_{\tau\in[t-P,t-1]}(\mathbb{R}\,(d_\tau\neq 0)+|e_\tau|^2)$
         2. $d_{\hat{\tau}}\leftarrow 0$
   b. If $d_{t-p}\neq 0$
      i. L←L−1

In some embodiments, $n_t$ may lie outside your range $[K_L, K_U]$. Therefore, in this example the method is able run a second pass based upon the output 1. y←unwrap(x)
2. Repeat until no wrapping is detected
   a. x←y
   b. y←unwrap(x)

In other words, the initial output from the a first complete run of the algorithm, which provides a restored audio signal, may be further used as a new input for further refinement. Therefore, after a second pass of the algorithm a second restored audio signal may be provided by the algorithm which represents an improvement on the first output. This embodiment of the method has guaranteed convergence as the set of paths reachable from each y include the original path x, therefore the successive iterations must find a path that is at least as good as the previous path.

In further embodiments of the present method, time varying filters may be provided. The above examples describe static/predetermined filters, however, the best accuracy can be achieved using a time varying filter. The reason is that the likely places for wrapping vary with the type of the sound in the audio signal. For example, in speech the fricatives are quite different to voiced parts.

The method may comprise partitioning the audio signal into audio frames (that is, a local region of the audio which may be comprised of a plurality of individual signal samples), for example of length of about 10 ms. There is the provided a method which may determine an appropriate filter to use for each audio frame. Rather than have an abrupt transition between the filer coefficients for each audio frame, the method may overlap the audio frames and may further crossfade the filter coefficients.

For example, the method may dynamically vary the filter order as well as the filter coefficients. The filter order can only increase by one for each sample for the algorithm to work, so it may be necessary to ramp the filter order up over successive samples if it increases by more than 1. This is fairly simple modification to the procedure outlined previously.

It is preferred to use a static filter for the first pass through the unwrap algorithm. The output from this first pass is then the input to the second pass where preferably, the method may allow the filter to be time varying. In this second pass, in one example, the method may directly estimate the filters by applying the filter design equation to each audio frame. However, the filter design will be corrupted by any transients missed in the first pass. In a preferable example, therefore, a dictionary approach may be used. For each audio frame, a filter design may be derived using a dictionary of autocorrelation matrices where the autocorrelation matrices are derived from clean examples of audio.

Let $R_k$ be an autocorrelation matrix in our dictionary of autocorrelation matrices.

Let x be an arbitrary audio frame (i.e., a subset of the complete audio signal comprising a plurality of signal-samples), where the audio frame is L sample long. We can define the probability of x given the $R_k$ as a multivariate distribution:

$$X=\begin{bmatrix} x_{L-1} & \cdots & x_{L-P-1} \\ \cdots & \ddots & \vdots \\ x_p & \cdots & x_0 \end{bmatrix}$$

$$p(x|k)\propto \det R_K^{P-L}\exp(-tr(XR_k^{-1}X^T))$$

If we set $Z=X^TX$ can rearrange this to give $$p(x|k)\propto \det R_K^{P-L}\exp(-tr(Z_k^{-1}))$$

We can also have a prior probability $p_k$ for each dictionary, and via Bayes rule $$p(k|x)\propto p(x|k)p_k$$

This leads the best choice of dictionary $\hat{k}$ as $$\hat{k}\leftarrow \arg\max_k(-tr(ZR_k^{-1})-(L-P)\text{In}\det R_k+\text{In}\,p_k)$$

Each autocorrelation matrix has an associated filter as derived by:

$$\alpha_k=\frac{1}{v^TR_k^{-1}v}R_k^{-1}v$$

This allows the method to select a filter design for each audio frame based upon the autocorrelation matrix in the dictionary that best matches the audio frame. As previously described, in some embodiments of the method, given the above, the method can perform multiple passes of the algorithm, and may re-choose the dictionaries (and therefore vary the filter chosen) for each audio frame and for each pass.

For example, the method provides for means to learn the dictionary of autocorrelation matrices using a variant of Gaussian Mixture Model Clustering. Each cluster has a centroid covariance and zero mean. The algorithm iteratively assigns each audio frame from the training data to the closest clusters, and then updates the centroid for each cluster as follows:

1. Let $X_m$ be an Toeplitz matrix representing an audio frame from our training data set,
2. Let the set of all $X_m$ be the training frames
3. For all our training frames calculate $Z_m\leftarrow X_m^TX_m$
4. Randomly choose a subset of the training frames to use as the initial dictionary estimates $R_k$
5. Repeat until converged
   a. Assign training frames to clusters by $\hat{k}_m\leftarrow\text{argmax}_k(-\text{tr}(Z_mR_k^{-1})-(L-P)\text{ In det }R_k)$
   b. Let $M_k$ be the set of training frames associated with cluster k c. Update the centroid to each cluster as $$R_k \leftarrow \frac{1}{|M_k|}\sum_{m\in M_k} Z_m$$

6. Estimate $p_k$ based upon the number of elements in each cluster.

There are lots of variants on this sort of clustering, for example how to handle clusters that become nearly empty, and running multiple times with different random initialisations and taking best solution.

Example Implementation

FIG. 1 shows an example procedure/algorithm 100 outlining the steps of carrying out the unwrapping method of a distorted/wrapped audio signal to provide a restored audio signal. Prior to carrying out the procedure, an initial audio signal may be recorded/obtained externally 102 which may then become digitised 104 (or simply transferred from one digital medium to another), and possibly distorted (i.e. wrapped) by external means 103 (for example, the external transfer of digital audio data from one storage medium to another). The unwrapping steps of the unwrapping algorithm are as follows:

1. For all possible states $s_{-1}$ initialise $\hat{J}(s_{-1})=0$.
2. For each time (i.e., for each signal samples) t=0 to T:
   a. Calculate $e_t$, comprising applying the filter (106)
   b. Grow phase: for all possible $s_{t-1}$ and all possible $n_t$: (110)
      i.

$$J'\left(\begin{bmatrix} n_t \\ s_{t-1} \end{bmatrix}\right) \leftarrow \hat{J}(s_{t-1}) + f\left(\epsilon\left(\begin{bmatrix} n_t \\ s_{t-1} \end{bmatrix}\right)\right).$$

c. Shrink phase: for all possible $s_t$: (110)
      i.

$$n' \leftarrow \mathrm{argmin}_{n_{t-P}} J'\left(\begin{bmatrix} s_t \\ n_{t-P} \end{bmatrix}\right),$$

ii. $\mathbb{P}_t(s_t) \leftarrow n'$, (118)
      iii.

$$\hat{J}(s_t) \leftarrow J'\left(\begin{bmatrix} s_t \\ n' \end{bmatrix}\right).$$

3. Find $\hat{s}_T \leftarrow \mathrm{argmin}_{s_T} \hat{J}(s_T)$.
4. To extract the optimal estimate $\hat{n}$ (step 112), back track from t=T down to 0 doing:
   a. $n' \leftarrow \mathbb{P}_t(\hat{s}_t)$
   b.

$$s' \leftarrow \begin{bmatrix} \hat{s}_t \\ n' \end{bmatrix},$$

c.

$$\begin{bmatrix} \hat{n}_t \\ \hat{s}_{t-1} \end{bmatrix} \leftarrow s'.$$

And finally, provide the most likely corrected/restored audio signal:

$$\hat{y}=x+2\hat{n} \qquad \text{(step 114)}$$

It should be generally understood that this application of the Viterbi express the problem to be solved (unwrapping) in a manner where the minimum filtered cost is mapped onto the shortest path through a Viterbi lattice, where the Viterbi state corresponds to the degree of wrapping at each sample, and the path lengths between states correspond to the objective function of the filtered output.

Figure 2:
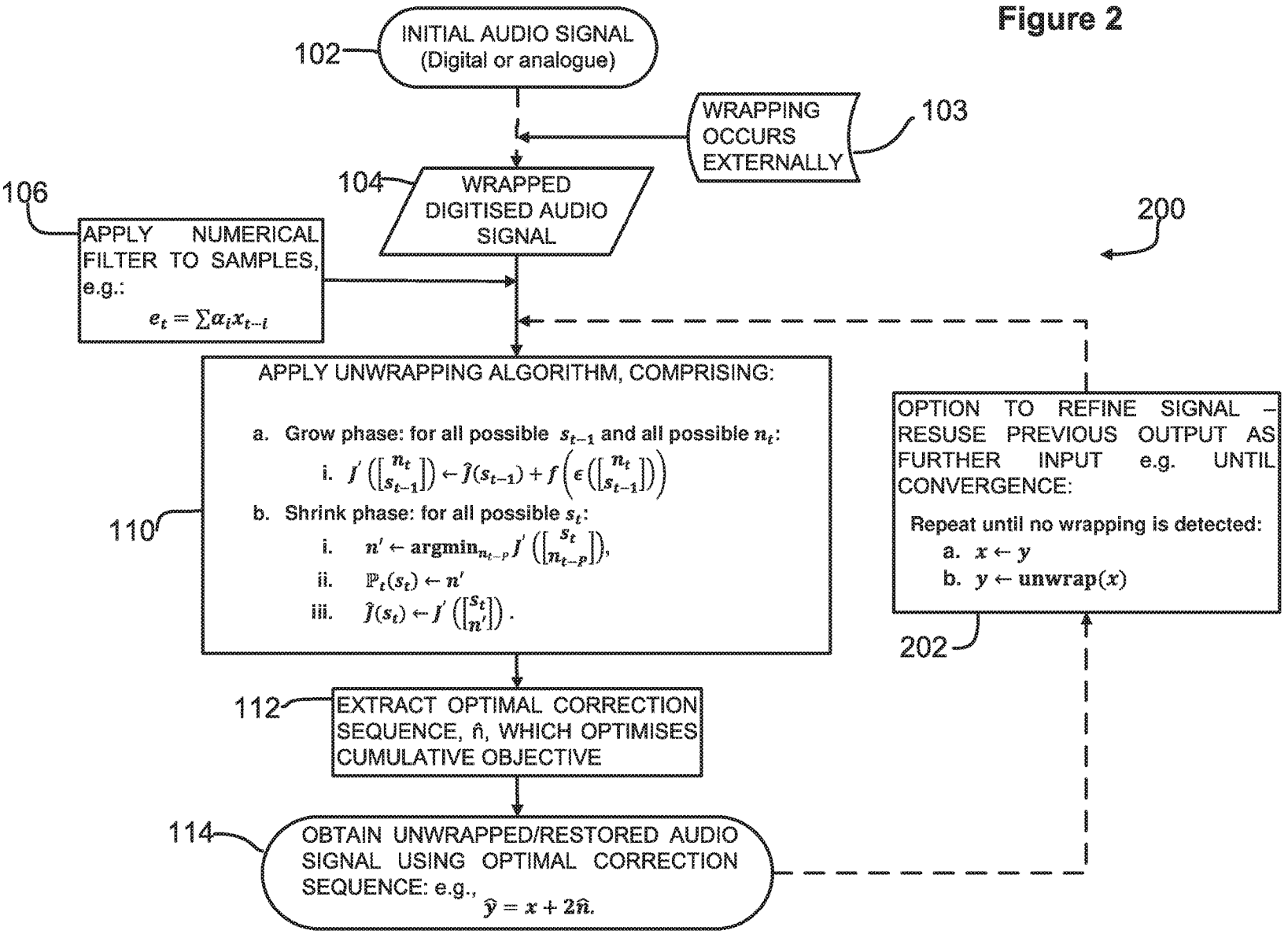
FIG. 2 shows a modified example procedure outlining the steps of carrying out the unwrapping algorithm comprising the method of further refining an output audio signal.

FIG. 2 shows an example procedure/algorithm 200 outlining the steps of carrying out an alternative implementation of the unwrapping method to provide a restored audio signal. Prior to carrying out the procedure, a source audio signal is recorded/obtained externally 102 which may then become digitised 104 (or simply transferred from one digital medium to another), and possibly distorted (i.e. wrapped) by external means 103. In embodiments of this algorithm, it will be understood that the choice of filter may be derived from one or more samples of clean audio, which may be saved in a dictionary. The filter is then applied to the signal samples of the audio signal in step 106. Further, the procedure 200 may perform multiple passes 202 on the audio signal, using the restored output as a further input for each pass, until a convergence is determined (or, optionally, a predetermined number of passes/iterations is done) to provide a refined—or a further refined—restored audio signal 206.

During each iteration/pass of 200, the general unwrapping algorithm is performed, which is an application of the Viterbi method. That is, it comprises wherein a cumulative objective is determined, for each of a set of paths (wherein the cumulative objective is determined for a path by accumulating the objective value from the filtered value for transitioning from each potential wrapping state in the path to the next potential wrapping state in the path), and wherein the filtered value for transitioning from each potential wrapping state in the path to the next potential wrapping state in the path is determined for the plurality of potential corrections; an optimum path which identifies the sequence of corrections is also determined. Finally, the optimum correction sequence for each pass is determined 112, and applied to the distorted signal to provide a restored signal as $\hat{y}=x+2\hat{n}$ 114. As discussed, it should be understood that performing enough iterative refinements 202 on successive restored audio signals has guaranteed convergence on the best possible (i.e. optimal) restored audio signal. That is, the optimal global solution which minimises the total cost of a filtered version of the unwrapped signal may be determined by such an iterative procedure.

Figure 3:
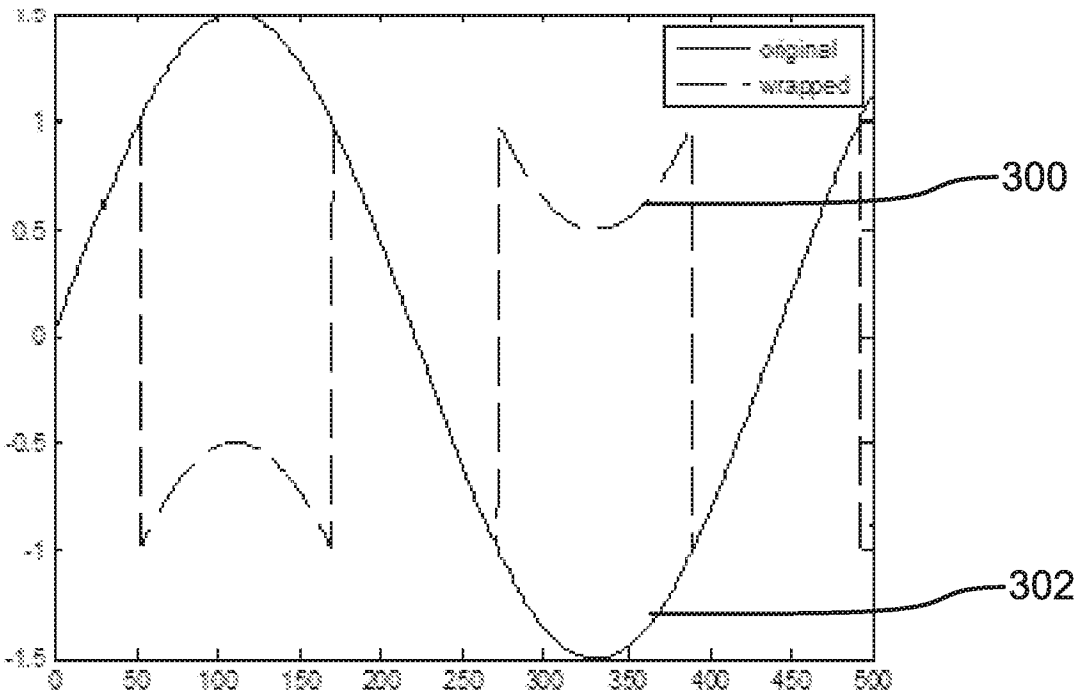
FIG. 3 shows an example of a digital audio signal which has been wrapped above/below values of +1 and −1.

FIG. 3 shows an example of region of an audio signal which has been wrapped. Specifically, the amplitudes at the extrema of the signal have been wrapped. For example, the local region of low amplitude 302 in the original/source audio signal has, upon digitisation, become wrapped to produce an erroneous signal at 300.

Figure 4:
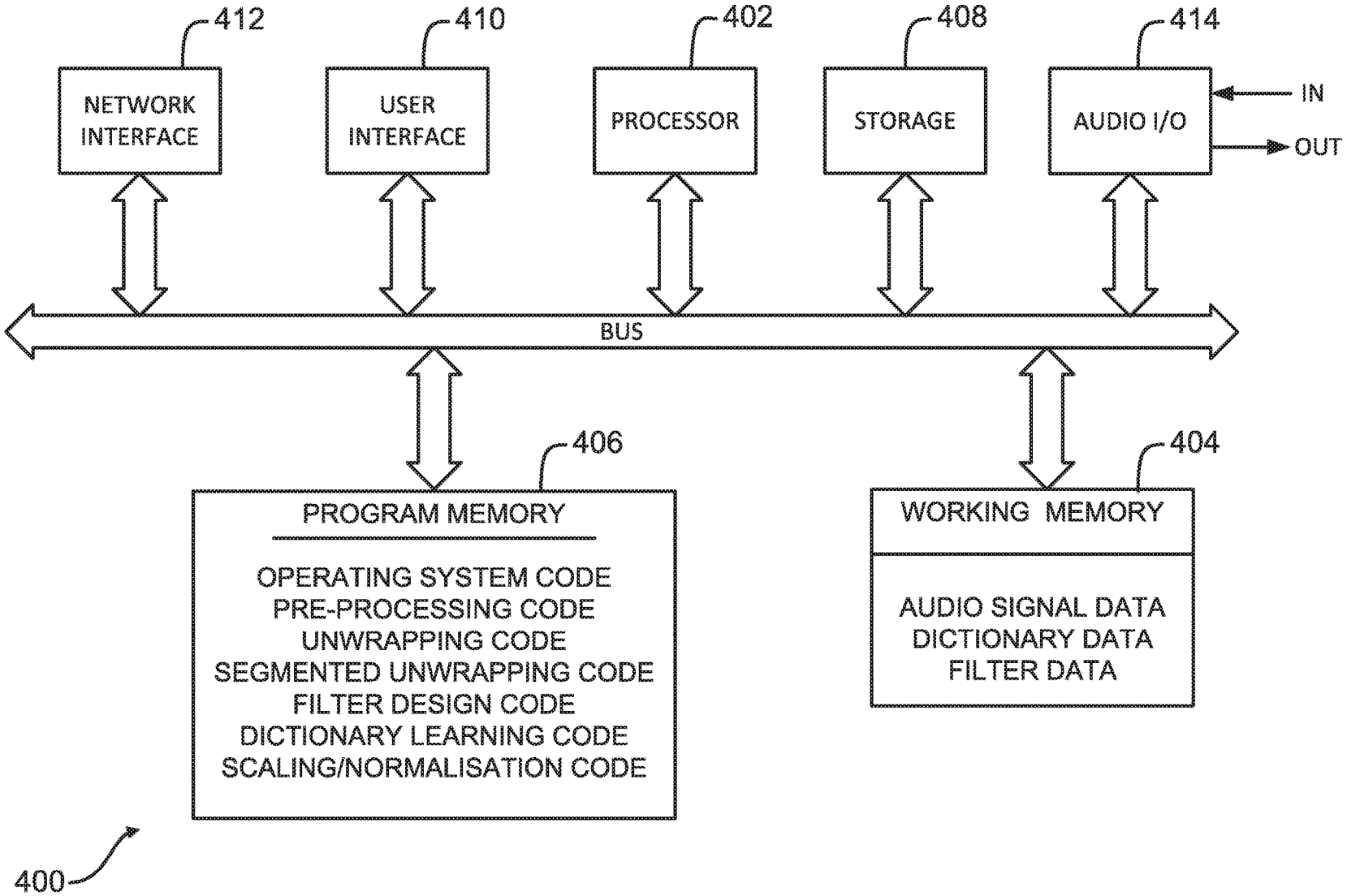
FIG. 4 shows an example of a general purpose computing system 500 programmed to implement the procedure of FIG. 1.

FIG. 4 shows an example of a general purpose computing system 400 programmed to implement the procedure of FIG. 1. This comprises a processor 402, coupled to working memory 404, for example for storing the audio data and/or filter/dictionary data, coupled to program memory 406, and coupled to storage 408, such as a hard disc or solid state storage media. Program memory 406 comprises code to implement embodiments of the invention, for example: operating system code, unwrapping code, segmented unwrapping code, audio signal detection and detection vector pre-processing code, correction sequence variable estimation code, graphical user interface code, filter calculation/design code, dictionary choosing/learning code, and scaling/normalisation code. Processor 402 is also coupled to a user interface 412, for example a terminal, to a network interface 412, and to an analogue or digital audio data input/output module 414. The skilled person will recognise that audio module 414 is optional since the audio data may alternatively be obtained, for example, via network interface 412 or from storage 408, or simply via the transfer from external digital storage media.

Figure 5:
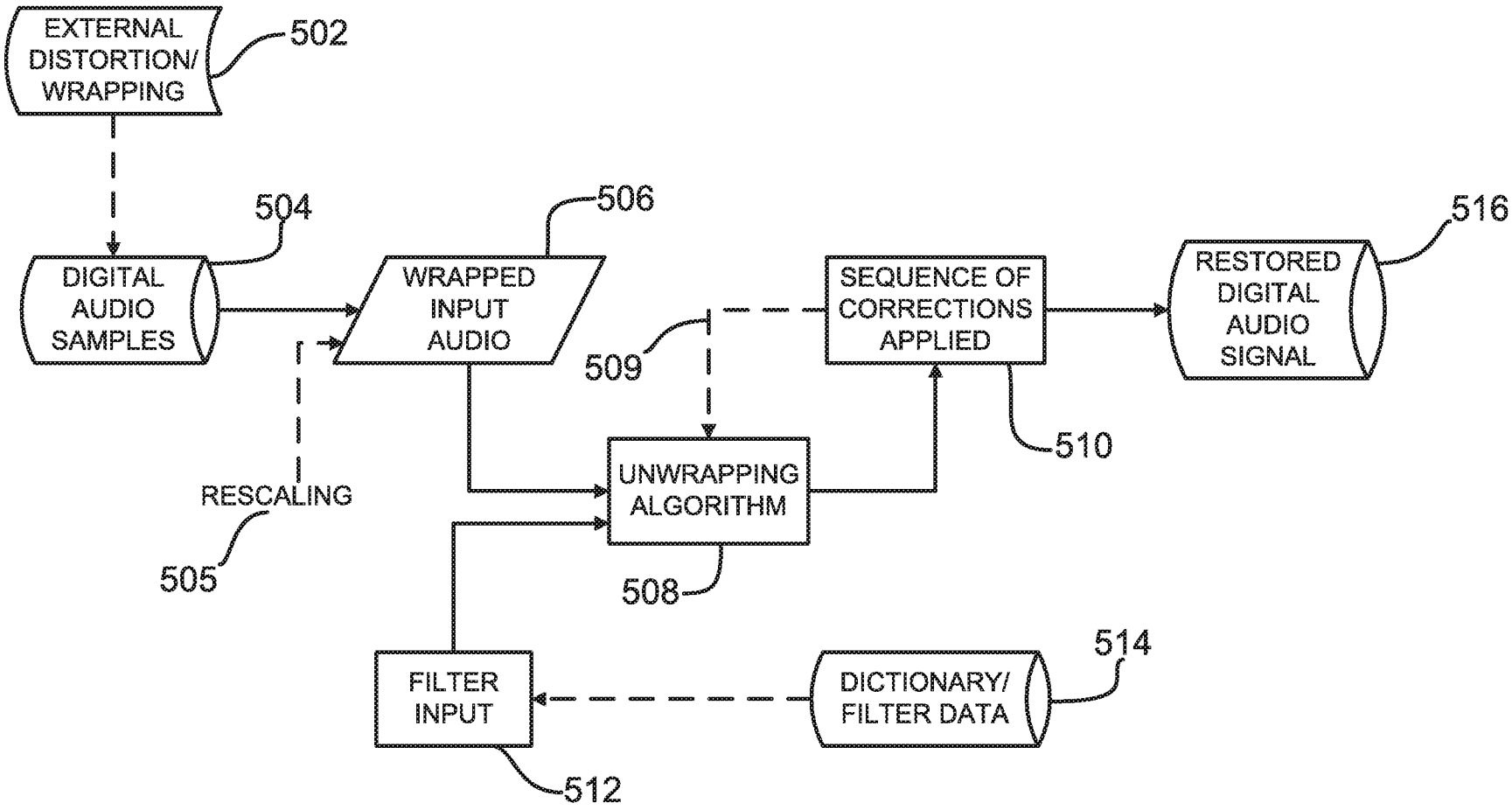
FIG. 5 shows an example architecture of a system to obtain a restored audio signal by the procedure of FIG. 1.

Referring to FIG. 5, this shows the architecture of a system 500 to restore an audio signal by the unwrapping algorithm. The method employs a Viterbi type algorithm, applied to an amplitude unwrapping method, to provide an optimum correction to the wrapped audio signal to provide a restored audio signal. The apparatus may comprise a digital storage medium 504, where it will be understood that this may also incorporate access to a network like the internet. The digital audio in 504 may have been transferred from some other digital medium, or may have been converted directly from an analogue signal and stored in 504. In general, for embodiments of this system, external distortion 502 may have occurred prior to the digital audio samples being stored in 504. For example, a transfer of digital audio from one external storage medium to another may have resulted in audio corruption, or in another example the distortion may have occurred directly upon converting from an analogue to a digital signal. The input audio signal 506 has thus been distorted by some external means or system prior to being applied to the apparatus and method of the current specification. Additionally, the present system provides for the input audio to be rescaled 605 (that is, the normalisation of the magnitudes of the amplitudes at each signal samples value) prior to being treated by the algorithm 508.

Therefore, the system provides a digitised signal 506 which, which may be normalised or rescaled 505, prior to being unwrapped by the algorithm 508 to provide an optimum sequence 510 of correction values. In 510, the optimum sequence of correction values ft may be applied to the wrapped input audio signal to provide the restored signal as $\hat{y}=x+2\hat{n}$. Numerical filter values may be applied 512 to the distorted audio prior to or during the unwrapping procedure. Advantageously, these filter values may only need to be applied to the observed digital audio signal once, prior to the unwrapping 508. Further, in some embodiments, the filter may be a dynamic filter and may be derived from dictionaries 514 stored in some other digital medium, or optionally downloaded from a network, or further optionally derived by some learning algorithm.

Loop 509 may provide for the method to use the restored signal, determined after applying the correction sequence 510, as a further input in order to provide a further refined signal back in 510. The restored audio provided in 510 may be further stored in 516 as a new digital audio signal. Nevertheless, it will be understood by the skilled person that the restored audio signal may, for example, be provided to a digital-to-analogue converter to provide a time domain audio output, for example to headphones or the like, or for other storage or further processing (for example speech recognition), or sent over a wired or wireless network such as a mobile phone network and/or the Internet, or many other uses.

No doubt many other effective alternatives will occur to the skilled person. It will be understood that the invention is not limited to the described embodiments and encompasses modifications apparent to those skilled in the art lying within the scope of the claims appended hereto.

The invention claimed is:

1. A computer-implemented method for restoring a wrapped audio signal, wherein the wrapped audio signal comprises a plurality of digitised signal samples at respective sample times, the method comprising:

estimating a sequence of corrections comprising a sequence of numerical values to be applied to corresponding values of the plurality of digitised signal samples of the wrapped audio signal, or estimating a sequence of corrected signal samples, the estimating comprising, for each digitised signal sample:

applying, at the sample time, a numerical filter to each of a set of potential corrections or set of potential corrected signal samples to determine a filtered value associated with each set of potential corrections or set of potential corrected signal samples, wherein the corrections are integers or the potential corrected signal samples comprise signal samples modified by integer multiples of a correction constant, wherein the numerical filter enhances the filtered value at sample times when a change in a degree of wrapping occurs relative to sample times when a change in degree of wrapping does not occur;

determining a cumulative objective over a plurality of signal samples by accumulating objective values, each objective value being determined by applying an objective function to the filtered value associated with each set of potential corrections or set of potential corrected signal samples; and determining a sequence of corrections or sequence of corrected signal samples, one for each digitised signal sample, by selecting for each sample time a correction or corrected signal sample from the set of potential corrections or set of potential corrected signal samples for the sample time, wherein the correction or corrected signal sample for each sample time are selected to optimise the cumulative objective; and determining a restored version of the wrapped audio signal using the sequence of corrections or corrected signal samples.

2. A method as claimed in claim 1 wherein a potential wrapping state comprises a potential correction from the set of potential corrections or a potential corrected signal sample from the set of potential corrected signal samples, and wherein there are multiple potential wrapping states for each sample time; the method further comprising:

determining the cumulative objective, for each of a set of paths, each path comprising a time sequence of the potential wrapping states, one for each sample time, wherein the cumulative objective is determined for a path by accumulating the objective value from the filtered value for transitioning from each potential wrapping state in the path to the next potential wrapping state in the path, and wherein the filtered value for transitioning from each potential wrapping state in the path to the next potential wrapping state in the path is determined for the plurality of potential corrections or plurality of potential corrected signal samples defined by both the potential wrapping state and next potential wrapping state; and identifying an optimum path which identifies the sequence of corrections or corrected signal samples used to determine the restored version of the wrapped audio signal.

3. A method as claimed in claim 1 wherein a potential wrapping state comprises a plurality of potential corrections from the set of potential corrections or a plurality of potential corrected signal samples from the set of potential corrected signal samples, and wherein there are multiple potential wrapping states for each sample time; the method further comprising:

determining the cumulative objective, for each of a set of paths, each path comprising a time sequence of the potential wrapping states, one for each sample time, wherein the cumulative objective is determined for a path by accumulating the objective value from the filtered value for transitioning from each potential wrapping state in the path to the next potential wrapping state in the path, and wherein the filtered value for transitioning from each potential wrapping state in the path to the next potential wrapping state in the path is determined for the plurality of potential corrections or plurality of potential corrected signal samples defined by both the potential wrapping state and next potential wrapping state; and identifying an optimum path which identifies the sequence of corrections or corrected signal samples used to determine the restored version of the wrapped audio signal.

4. A method as claimed in claim 1 wherein the objective function is a cost function and the cumulative objective is a cumulative cost, and wherein the correction or corrected signal sample for each sample time are selected to minimise the cumulative cost determined from the cost function.

5. A method as claimed in claim 1 wherein the objective function is a probability function and the cumulative objective is a cumulative likelihood, and wherein the correction or corrected signal sample for each sample time are selected to maximise the cumulative likelihood determined from the probability function.

6. A method as claimed in claim 1, wherein the corrections are chosen from a discrete set of integers between an upper and lower bound.

7. A method as claimed in claim 1, wherein the wrapped audio signal possesses at least one region of the plurality of digitised signal samples at respective sample times having wrapped amplitude, and wherein the restored audio signal possesses an amplitude at each sample time determined to be a most-likely original amplitude of a source audio signal.

8. A method as claimed in claim 1, the method further comprising:

refining a previous estimation of the restored audio signal, the refining comprising:

reusing the previous estimation of the restored audio signal as a further input audio signal;

estimating one or more further sequence of corrections comprising a sequence of numerical values to be applied to corresponding values of the plurality of digitised signal samples of the further input audio signal, or estimating a further sequence of corrected signal samples;

determining a refined restored version of the wrapped audio signal using the further sequence of corrections or further corrected signal samples.

9. A method as claimed in claim 8, wherein a further numerical filter is applied for each reuse of the previous estimation of the restored audio signal as a further input audio signal.

10. A method as claimed in claim 1, wherein the numerical filter is a predetermined numerical filter comprising one or more constant numerical values.

11. A method as claimed in claim 1 wherein the numerical filter is predetermined, and wherein the numerical filter is determined from a representative clean audio signal having unwrapped audio.

12. A method as claimed in claim 1, wherein the numerical filter is a time dependent numerical filter, and wherein the time dependent numerical filter is varied for at least one of the signal-samples for which the numerical filter is applied.

13. A method as claimed in claim 12, wherein the calculation of the time dependent numerical filter is based on one more properties of one or more local regions of the wrapped audio signal, and wherein each local region comprises a plurality of digitised signal samples.

14. A method as claimed in claim 1, the method comprising:

processing the wrapped audio signal before estimating the sequence of corrections or estimating the sequence of corrected signal samples, the processing comprising:

applying to each of the plurality of digitised signal samples a distortion-likelihood function to provide a plurality of distortion-likelihood values;

determining a subset of signal samples from the plurality of digitised signal samples, wherein the determining is based on comparing the plurality of distortion likelihood-values to a threshold value.

15. A method as claimed in claim 14, wherein the subset of signal samples comprises signal samples at sample times when a change in the degree of wrapping is determined to be likely relative to nearby signal-samples.

16. A method as claimed in claim 14, further comprising:

determining the cumulative objective, for each of a set of paths, each path comprising a time sequence of the potential wrapping states, one for each sample time, wherein the cumulative objective is determined for a path by accumulating the objective value from the filtered value for transitioning from each potential wrapping state in the path to the next potential wrapping state in the path, and wherein the filtered value for transitioning from each potential wrapping state in the path to the next potential wrapping state in the path is determined based only on the subset of signal samples.

17. A non-transitory computer-readable medium having executable processor control code to, when executed, implement the method of claim 1.

18. A signal processing system for restoring a wrapped audio signal, wherein the wrapped audio signal comprises a plurality of digitised signal samples at respective sample times, the system comprising one or more processors configured to:

estimate a sequence of corrections comprising a sequence of numerical values to be applied to corresponding values of the plurality of digitised signal samples of the wrapped audio signal, or estimate a sequence of corrected signal samples, the estimating comprising, for each digitised signal sample:

applying, at the sample time, a numerical filter to each of a set of potential corrections or set of potential corrected signal samples to determine a filtered value associated with each set of potential corrections or set of potential corrected signal samples, wherein the corrections are integers or the potential corrected signal samples comprise signal samples modified by integer multiples of a correction constant, wherein the numerical filter enhances the filtered value at sample times when a change in a degree of wrapping occurs relative to sample times when a change in degree of wrapping does not occur;

determining a cumulative objective over a plurality of signal samples by accumulating objective values, each objective value being determined by applying an objective function to the filtered value associated with each set of potential corrections or set of potential corrected signal samples; and determine a sequence of corrections or sequence of corrected signal samples, one for each signal sample, by selecting for each sample time a correction or corrected signal sample from the set of potential corrections or set of potential corrected signal samples for the sample time, wherein the correction or corrected signal sample for each sample time are selected to optimise the cumulative objective; and determine a restored version of the wrapped audio signal using the sequence of corrections or corrected signal samples.

* * * * *